United States Patent [19]

Tummel

[11] 4,175,626

[45] Nov. 27, 1979

[54] FLUID-JET DRILL

[76] Inventor: Harold Tummel, 4630 Cole St., Dallas, Tex. 75205

[21] Appl. No.: 942,642

[22] Filed: Sep. 15, 1978

[51] Int. Cl.[2] ..... E21B 7/18

[52] U.S. Cl. ..... 175/422; 166/223

[58] Field of Search ..... 175/393, 422, 92; 166/222, 223; 285/272, 275, 276

[56] References Cited

U.S. PATENT DOCUMENTS

| | | | |
|---|---|---|---|
| 1,695,749 | 12/1928 | Watson | 166/223 |
| 1,715,767 | 6/1929 | Flore | 166/223 |
| 2,218,130 | 10/1940 | Court | 175/92 |
| 3,266,577 | 8/1966 | Turner | 166/222 |
| 4,031,971 | 6/1977 | Miller | 175/422 |

*Primary Examiner*—James A. Leppink

[57] ABSTRACT

A fluid-jet drill with a forward relatively rotatable cylindrical sleeve having a first set of openings through which fluid is directed to impinge upon the substance to be drilled and a second set of openings rearward of the forward end of the sleeve with axes directed at an angle to a tangent to the external surface of the sleeve through which a portion of the fluid is expelled to cause rotation of the cylindrical sleeve.

4 Claims, 3 Drawing Figures

VIEW A-A' @ C-C'

VIEW A-A' @ B-B'

FLUID-JET DRILL

SUMMARY OF THE INVENTION

The object of the invention is to provide a fluid jet drill that can be used with minimal energy dissipation in deep hole drilling. This invention works by utilizing a high pressure fluid jet to erode the surface to be drilled. The high pressure fluid stream is also employed to create tangential jets which cause the rotation of the drill head which in turn determines a desired hole geometry. By selectively modifying the dimensions of the effluent passages which develop the erosion and tangential jets, the hole geometry and drilling speed may be modified. The drill and the fluid supply line are sheathed in a low-density material which buoys the entire subsurface assembly. Thus, this invention provides a means of deep hole drilling which does not involve repeated hoisting of a long "drill string" as is required with conventional rotary drills. The use of a buoyant assembly enables the drilling of arbitrarily deep holes in a fashion free from the problem of drilling assemblies incapable of supporting their own weight. The use of a high pressure fluid jet for eroding the surface to be drilled enables the application to the surface to be drilled of power which is substantially greater than that which currently can be applied with conventional rotary drills.

BRIEF DESCRIPTION OF THE DRAWINGS

FIG. I shows a cross-sectional view of the invention.
FIG. II shows a view along the line A-A' of 6.
FIG. III shows a view along the line A-A' of 3.

DETAILED DESCRIPTION OF PREFERRED EMBODIMENTS

Figure 1:
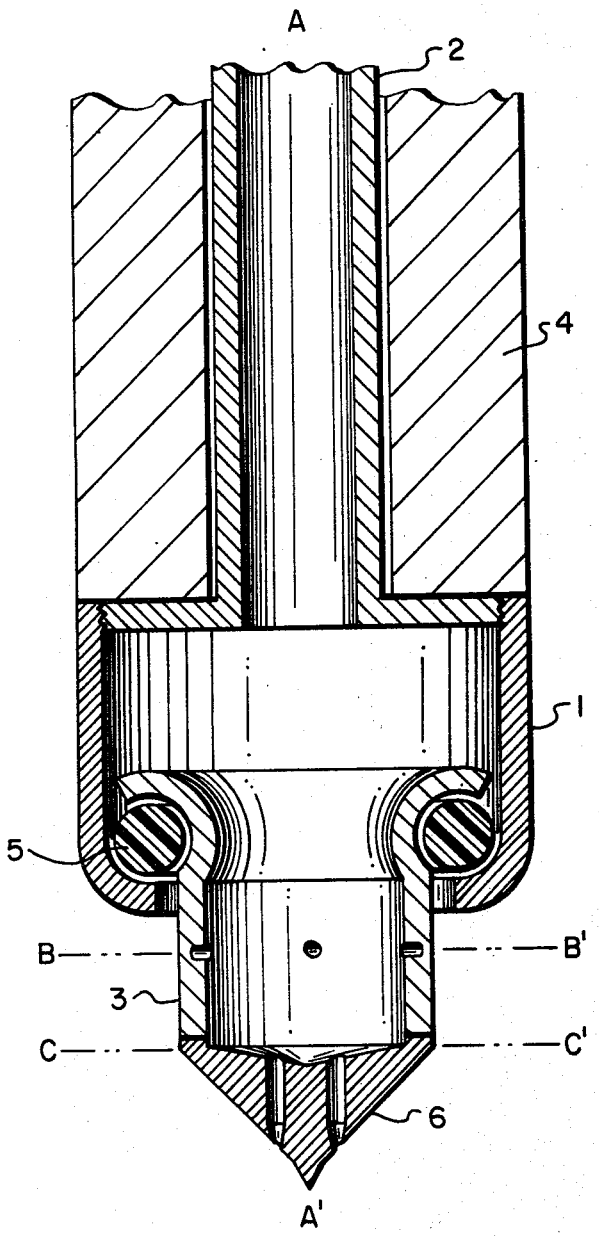
Figure 2:
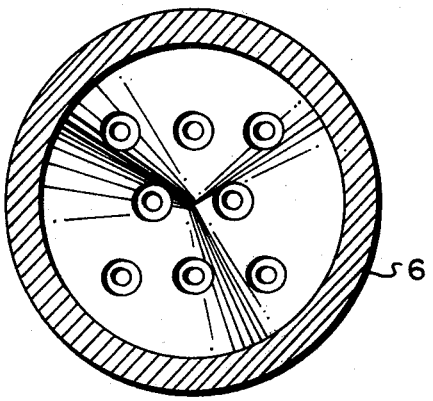
Figure 3:
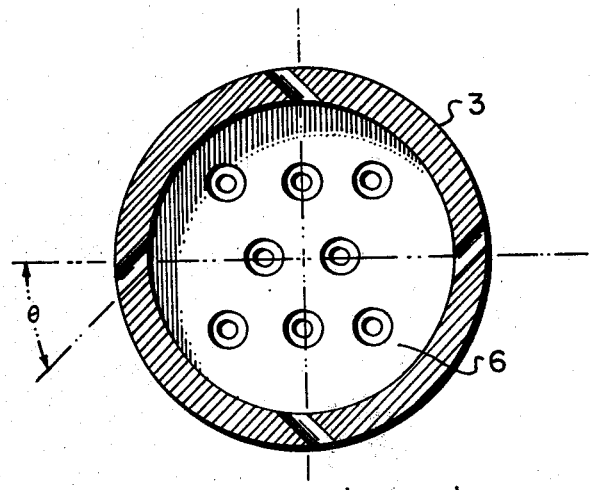

A cylindrical sleeve 1 is rearwardly threadedly connected to the flared end of a cylindrical sleeve 2. The outside diameter of the cylindrical sleeve 2 is less than the inside diameter of the cylindrical sleeve 1. The cylindrical sleeves 1 and 2 are coaxial. The cylindrical sleeve 2 is sheathed in a cylindrical sleeve 4 composed of a low-density material. The outside diameter of the cylindrical sleeve 4 is equal to that of the cylindrical sleeve 1. The forward end of the cylindrical sleeve 1 is curved inward so as to retain forwardly the ring 5. The ring 5, of circular cross-section, has a maximum outside diameter which is slightly less than the inside diameter of the cylindrical sleeve 1. A cylindrical sleeve 3 extends coaxially forwardly out of the cylindrical sleeve 1. The rearward end of the cylindrical sleeve 3 is curved outward so as to retain rearwardly the ring 5. The forward edge of the cylindrical sleeve 1, the ring 5, and the rearward edge of the cylindrical sleeve 3 function as a bearing. The forward edge of the cylindrical sleeve 3 is permanently coaxially affixed to the large diameter end of a solid cone 6 with maximum outside diameter equal to that of the cylindrical sleeve 3. Several Venturi-shaped openings extend through the solid cone 6, with axes parallel to the axis of the cylindrical sleeve 3. Several cylindrical openings extend through the cylindrical sleeve 3 with axes lying in the plane perpendicular to the page and determined by the line B-B'. Said cylindrical openings extending through the cylindrical sleeve 3 are at a distance rearward from the solid cone 6 and at a distance forward of the forward most extreme of the cylindrical sleeve 1. Said cylindrical openings extending through the cylindrical sleeve 3 are oriented so that their axes form fixed angles $\theta$ with radii of the cylindrical sleeve 3 lying in the plane perpendicular to the page and determined by the line B-B'. Said fixed angles $\theta$ have measure strictly greater than zero and less than $\pi/2$. A high pressure fluid flows forwardly through the cylindrical sleeve 2, thence forwardly into the cylindrical sleeve 1, thence forwardly into the cylindrical sleeve 3, thence through the cylindrical openings in the cylindrical sleeve 3 and through the Venturi-shaped openings in the solid cone 6. Fluid expelled through the Venturi-shaped openings in the solid cone 6 impinges upon the substance to be drilled. Fluid expelled through the cylindrical openings in the cylindrical sleeve 3 compels the rotation of the cylindrical sleeve 3 with respect to the cylindrical sleeve 1 about their common axis, Extension of the low-density material sheath 4 to the entire length of the fluid supply line buoys the whole of the subsurface assembly.

Although the invention has been described with particular reference to the drawings, the protection sought is to be limited only by the terms of the claims which follow.

What is claimed is:

1. A fluid-jet drill for subsurface drilling, comprising:

a first cylindrical sleeve, having its forward edge curved inward;

a second cylindrical sleeve, coaxial with the first cylindrical sleeve, having an outside diameter of lesser measure than the measure of the inside diameter of the first cylindrical sleeve, such that the forward end of the second cylindrical sleeve is flared to threadedly connect with the rearward end of the first cylindrical sleeve;

a ring of circular cross-section, having a maximum outside diameter of measure slightly less than the measure of the inside diameter of the first cylindrical sleeve, such that it is retained forwardly by the forward curved edge of the first cylindrical sleeve;

a third cylindrical sleeve, coaxial with the first cylindrical sleeve, extending forwardly out of the first cylindrical sleeve, having an outside diameter of lesser measure than the measure of the inside diameter of the first cylindrical sleeve, having its rearward edge curved outward, such that it extends through the center of said ring and such that its rearward edge retains rearwardly said ring;

a solid cone, coaxial with the first cylindrical sleeve, having a maximum outside diameter of measure equal to the measure of the outside diameter of the the third cylindrical sleeve, such that it is permanently rearwardly affixed at the end of its maximum outside diameter to the forward end of the third cylindrical sleeve;

a means for causing the rotation of the third cylindrical sleeve with respect to the first cylindrical sleeve about their common axis;

a means for accelerating and expelling forwardly through said cone a pressurized fluid, such that this accelerated and expelled fluid might impinge upon the substance to be drilled.

2. The device of claim 1 wherein the means for accelerating and expelling forwardly through said cone a pressurized fluid comprises:

several Venturi-shaped openings, extending through said cone, having axes parallel to the axis of the third cylindrical sleeve, such that they are oriented so as to accelerate a pressurized fluid forwardly.

3. The device of claim 2 wherein the means for causing the rotation of the third cylindrical sleeve with respect to the first cylindrical sleeve about their common axis comprises:

several cylindrical openings, extending through the third cylindrical sleeve, having axes lying in a plane perpendicular to the axis of the third cylindrical sleeve, being at a distance rearward from said cone, being at a distance forward of the most forward extreme of the first cylindrical sleeve, being oriented such that their axes form fixed angles with radii of the third cylindrical sleeve lying in a plane perpendicular to the axis of the third cylindrical sleeve, such that said fixed angles have measure strictly greater than zero and less than one half of pi radians and such that a pressurized fluid expelled through these cylindrical openings compels said rotation.

4. The device of claim 3 comprising:

a fourth cylindrical sleeve, coaxial with the first cylindrical sleeve, composed of a low-density material, having an outside diameter of measure equal to the measure of the outside diameter of the first cylindrical sleeve, having an inside diameter of measure slightly greater than the measure of the outside diameter of the second cylindrical sleeve, such that it is affixed to the second cylindrical sleeve and serves to buoy the whole of said device.

* * * * *